United States Patent [19]

Davis

[11] 4,137,434

[45] Jan. 30, 1979

[54] FLUID PRESSURE RESPONSIVE DEVICE

[76] Inventor: Allen V. C. Davis, 5600 Alta Canyada Rd., La Canada, Calif. 91011

[21] Appl. No.: 801,336

[22] Filed: May 27, 1977

[51] Int. Cl.[2] ..... H01C 35/34

[52] U.S. Cl. ..... 200/83 P; 200/83 S

[58] Field of Search ..... 73/406, 407 R, 407 PR; 200/83 P, 83 S, 83 J, 308

[56] References Cited

U.S. PATENT DOCUMENTS

| | | | |
|---|---|---|---|
| 2,824,919 | 2/1958 | Davis | 200/83 P |
| 3,535,480 | 10/1970 | Bahniuk | 200/83 P |
| 3,588,395 | 6/1971 | Hersey | 200/83 S |

FOREIGN PATENT DOCUMENTS

| | | | |
|---|---|---|---|
| 405441 | 2/1934 | United Kingdom | 200/83 P |
| 1028252 | 5/1966 | United Kingdom | 200/83 P |

*Primary Examiner*—Gerald P. Tolin
*Attorney, Agent, or Firm*—Perry E. Turner

[57] ABSTRACT

A pressure responsive device is shown for actuating an electric switch, such device having a port for connection to a source of fluid under pressure, the port being spanned by a diaphragm overlayed by a pressure plate that is adapted directly to actuate a snap action disc spring and a yoke member. An exteriorly adjustable threaded rod extends through the yoke member, and a helical spring has turns at one end threadedly engaging the yoke member, and turns at its other end engaging a shoe element that is threaded onto the rod. As the rod is turned in one direction, the shoe moves towards the inner end of the rod and thereby elongates the spring, i.e., places it in tension. Turning the rod in the opposite direction causes the shoe to move towards the external end of the rod and thereby place the coils of the spring in compression. The disc spring is set to be snap actuated by fluid pressure at a predetermined level intermediate the minimum and maximum pressures over which it is desired to be accommodated by the device, and within which the spring is neither in tension nor compression. The rod is turned to place the helical spring in tension when the device is to be operated at high pressures, and in compression when the device is to be operated at low pressures, and the deadband at all such pressure levels is substantially the same. The inner portion of the disc spring is coupled via a non-friction fulcrum mechanism to a pivotal arm for multiplying the motion of the disc spring and effecting opening and closing of the switch at the limits of the deadband.

6 Claims, 6 Drawing Figures

FLUID PRESSURE RESPONSIVE DEVICE

BACKGROUND OF THE INVENTION

1. Field of the Invention

This invention relates to pressure responsive devices for actuating movable elements such as electric switches, meter pointers or the like.

2. Description of the Prior Art

A pressure responsive device as heretofore known employs a diaphragm between a source of gas or liquid under pressure and a mechanism to be actuated at a predetermined pressure of such fluid for controlling the condition of a device such as an electric switch. See, for example, my U.S. Pat. No. 2,824,919, "Pressure Responsive Switch," of Feb. 25, 1958. In such prior art switches, a snap action negative rate disc spring causes the switch device to be closed at a predetermined fluid pressure, and to be opened at a second predetermined fluid pressure. An adjustable compression spring is provided with which to cause the device to work within a desired pressure range. The pressure differential for opposite disc spring movements is the deadband, i.e., the difference between the pressure that causes the disc spring to snap to depress the extended switch plunger and the pressure at which the disc spring snaps back to permit the switch plunger to return to extended position. However, such pressure responsive devices are characterized in that their deadband varies considerably at different pressure levels. In this regard, a phenomenon of a diaphragm is that it alone causes a substantial variation in deadband at different pressure ranges or levels, with the deadband increasing substantially with increase in pressure, e.g., from 10-psi in the vicinity of 100–110 psi applied pressure to 75-psi in the vicinity of 925–1000 psi applied pressure. The combined effects of a negative rate snap action disc spring and a positive rate compression spring in a device having such a diaphragm are not able to compensate for the effect of the apparent variable spring rate of the diaphragm. Rather, such variable rate of the diaphragm has been recognized and viewed as an inherent limitation of pressure responsive devices employing them, as to which no solution has existed to easily and simply remove the same.

SUMMARY OF THE INVENTION

This invention embraces a pressure responsive device having a diaphragm exposed on one surface to a source of fluid pressure, a movable member against the other surface being biased to require a predetermined pressure for its movement via a snap action negative rate disc spring, and a helical spring coupled to said disc spring and selectively adjustable to be placed in compression or in tension, respectively, at pressures below and above the predetermined pressure, the number of turns and degree of compression or tension of the helical spring causing the deadband at all desired levels to be substantially the same.

DESCRIPTION OF PREFERRED EMBODIMENT

Figure 2:
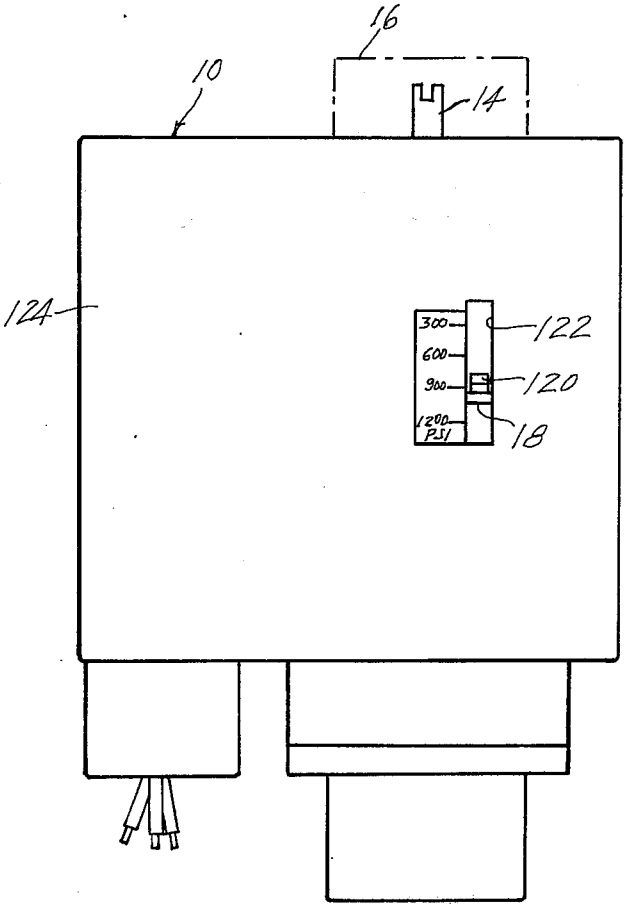
FIG. 2 is a back elevation view of the device of FIG. 1.
Figure 1:
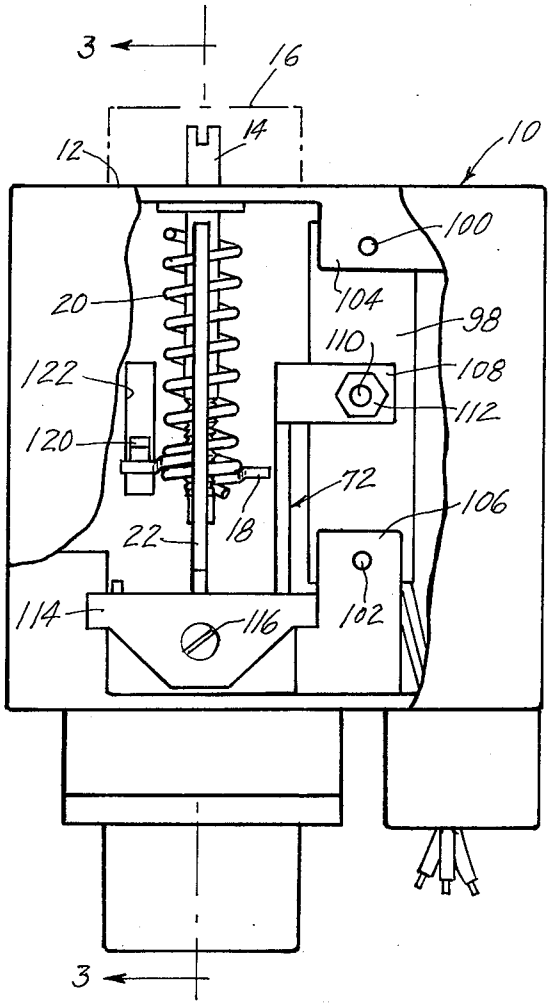
FIG. 1 is a front elevation view, partly broken away, of a pressure responsive device in accordance with this invention, showing the mechanism for putting the helical spring in tension or compression.
Figure 3:
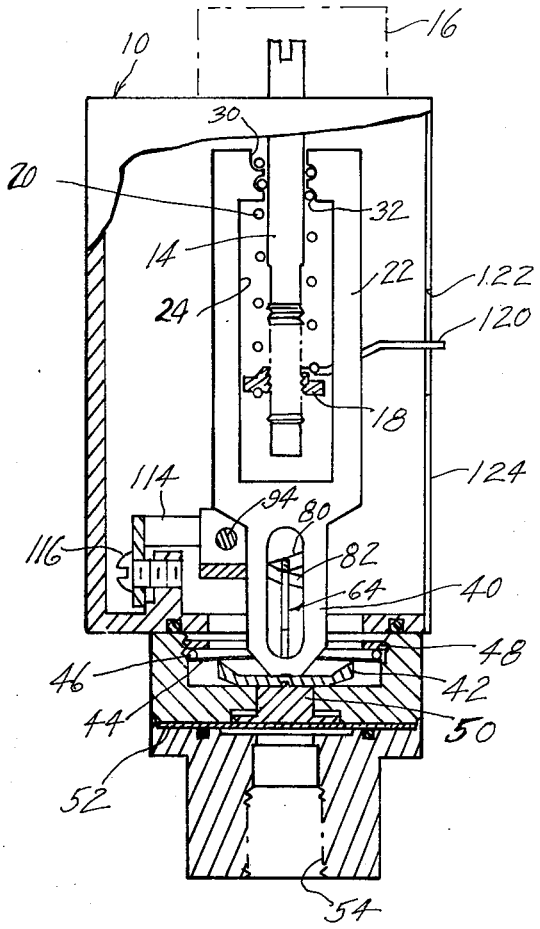
FIG. 3 is a partial sectional view taken along the line 3—3 of FIG. 1.

Referring to FIGS. 1–3, a housing 10 has a top wall 12 through which one end of a rod 14 extends. The exterior end of the rod 14 is shown slotted to receive a coin or screwdriver blade for turning the rod in either direction. Such exterior end of the rod is normally protected, as by a cap shown in phantom at 16.

The rod is threaded along the inner half portion thereof and threaded onto the rod is shoe member 18. A helical spring 20 surrounds the rod 14, and the shoe 18 is shaped to be matingly threadedly engaged with the bottom turn of the spring. Thus, the shoe carries the lower end of the spring with it as the shoe is moved along the threaded portion of the rod.

The upper portion of the spring is captured by the upper end of a yoke member 22 (FIGS. 1 and 3). Preferably, as best seen in FIG. 3, the yoke 22 is a flat element having a generally rectangular, elongated opening 24 astride the rod 14, shoe 18 and spring 20. The upper end of the yoke 22 is split, with the edges confronting the rod having grooves staggered to facilitate assembly of the yoke onto the upper turns of the spring 20. As shown, these confronting edges have respective semicircular grooves whereby to capture the portions of the turn of the helix fitted therein. The upper end of the spring fits in a notch 30 in the top of the left side portion confronting the rod. Also, the right hand portion of the yoke confronting the rod has a notch 32 for receiving the portion of the turn of the spring extending around the rod from the semicircular groove in the left hand portion of the yoke.

Thus, with a portion of a turn of the spring being captured by the upper end of the yoke, turning of the rod 14 causes the lower end of the spring to move relative to the upper end thereof. In this regard, the spring 20 is conditioned via the positioning of the shoe 18 to be in tension or in compression. Further, the spring has a position in which it is not stressed, i.e., it is neither in tension nor compression, from which position downward movement of the shoe elongates the spring and puts it in tension, or from which position upward movement of the shoe compresses the spring. Still further, when the shoe moves to the lower end of the threaded portion of the rod, the portion of the turn in the notch 32 at the rest position has moved completely out of such notch, i.e., providing additional active portions of the spring for tensioning. Correlatively, when the shoe moves towards the upper end of the threaded portion of the rod, the number of turns of the spring which bottom against each other and become inactive increases progressively. In a typical example, there are 1.5 – 2.0 more active turns in tension than in compression for a spring having six uncaptured turns in the unstressed condition of the spring.

The foregoing spring conditions are utilized to effect a substantially constant deadband for a pressure responsive device throughout a substantial number of pressure levels of fluid applied to the device. Again referring to FIG. 3, along with FIGS. 1 and 2, the yoke 22 has an extension 40 that extends through the bottom wall of the housing 10 and is welded to the center of a spring register element 42, which is a shallow cup-like member having its upper edge engaging the body of a snap action disc spring 44 of the negative spring rate type. The periphery of the disc spring 44 is in registry with a ring 46 and held in place via an adjustment screw element 48.

The bottom surface of the cup register 42 is in abutment with the upper end of a pressure plate 50 that rests on the upper surface of a diaphragm 52 that spans a port 54 through which to admit fluid under pressure. It will be understood that conventional arrangements are used to secure the pressure plate support block to the housing 10, and to secure the ported block to the pressure plate support block with the diaphragm clamped in place, along with conventional sealing means.

Figure 4:
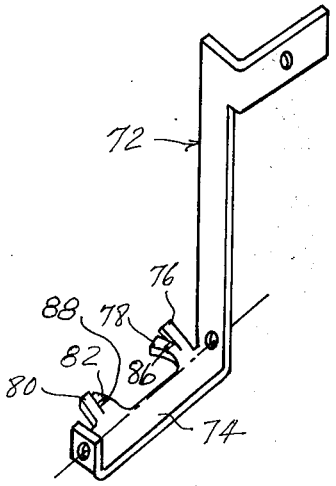
FIG. 4 is a perspective view of the switch-actuating lever in the device of FIG. 1, showing the formed fingers on which the fulcrum member is placed.
Figure 5:
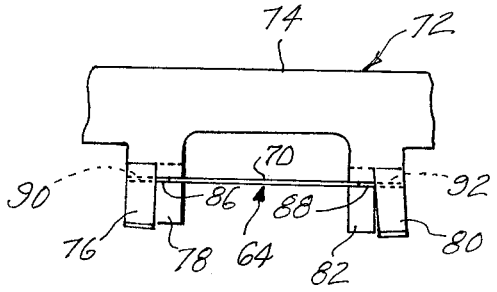
FIG. 5 is a fragmentary top plan view of the portion of the lever on which the fingers are formed, to better aid in understanding the operation of the fulcrum member.
Figure 6:
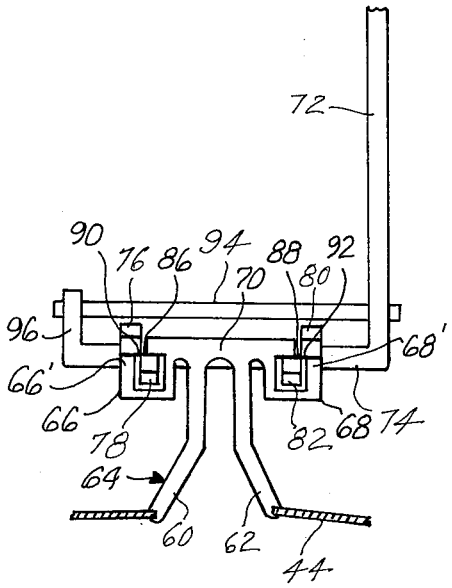
FIG. 6 is a fragmentary view in elevation of the lever with the fulcrum member in position thereon, and showing in section the inner portion of the snap action disc spring captured by the legs of the fulcrum member.

Referring to FIGS. 4–6 along with FIGS. 1 and 3, the inner peripheral edge of the disc spring 44 has the legs 60, 62 of a fulcrum member 64 snapped thereon, such legs being notched for this purpose. The member 64 is a stamping of thin metal having spring characteristics. As shown in FIG. 6, the member 64 has generally U-shaped end portions 66, 68 extending from a top strip portion 70 such that end tabs of such portion 70 and the ends 66', 68' of the portions 66, 68 have colinear edges. Such edges engage and are preferably captured by a lever element 72 which has a horizontal leg 74 with integral split finger pairs 76, 78 and 80, 82 extending from one edge. As shown, the finger pairs are bent in opposite directions, with the upper surfaces of the inner fingers 78, 82 having flats 86, 88 (see FIG. 5) sufficiently narrow to accommodate and support the bottom edges of the end tabs of the top strip portion 70, and similar flats 90, 92 on the bottom surfaces of the outer fingers 76, 80 for the ends 66', 68' of the portions 66, 68. By so shaping the finger pairs, the end tabs of the portion 70 and the ends 66', 68' of the portions 66, 68 are readily snapped into place with the colinear edges riding on the flat portions, which are also colinear. The result is a substantially friction-free fulcruming of the member 64 relative to the lever arm 74.

The lever 72 is pivoted on a pin 94 (see FIGS. 3 and 6) that extends through a vertical end tab 96 of the arm 74 and the vertical leg of the lever 72. Since the member 64 is positioned in a plane that is parallel to the axis of the pin 94, movement of the disc spring 44 effects movement of the lever 72 about the pin axis. In the embodiment shown, the upper end of the lever 72 is adapted for opening and closing a switch during such movements. In FIG. 1, a switch device 98 is shown supported at 100, 102 on posts 104, 106 that are integral portions of the housing 10. The upper end of the lever 72 has an integral extension 108 at right angles to the vertical leg thereof, in which a threaded element 110 extends for engaging the plunger (not shown) of the switch 98. A nut 112 is provided for holding the threaded element 110 in position after it is adjusted to effect the operations of the switch. Pivotal movement of the lever is limited via the action of the disc spring, and the extent of movement of the switch actuating element 110 is determined by the ratio of the length of the vertical arm of the lever 72 to the distance between the inner peripheral edge of the disc spring 44 and the peripheral edge of the spring register cup 42 that bears against the disc spring 44.

If desired, the ends of the pin 94 may be located in openings in inwardly extending abutments of the housing 10, or in openings in separate elements that are secured in place in the housing. In the instant embodiment, however, the ends of the pin are located against inwardly extending abutments, and are retained in such position by the ends of the arms of a stop member 114 (see FIGS. 1 and 3) that is secured in place by a threaded fastener as at 116.

The spring 20 is placed in a condition of tension or compression in accordance with the fluid pressure level at which it is desired to have the electric switch 98 operate. Referring to FIGS. 1–3, the shoe 18 has one end of a pointer 120 welded thereto, and the other end of such pointer extends through an opening 122 in the face plate 124. This arrangement prevents both the pointer 120 and shoe 18 from rotational movement as the rod 14 is turned to effect their vertical positioning. Pressure levels preferably are noted for different positions of the pointer as illustrated in FIG. 2. Thus, for the customer that requires an instrument to be operated at 1800-psi, the rod 14 is turned to the position that places the pointer 120 adjacent the 1800-psi legend. The same instrument purchased by a customer having a 400-psi source requirement is readily set for operation at that level by turning the rod to position the pointer end at the 400-psi legend.

In all such positions, this invention effectively balances out the effects of the apparent variable spring rate of the diaphragm which would otherwise cause the deadband at the higher setting to be substantially greater than at the lower setting of the instrument. To this end, the disc spring is preloaded via the adjustment nut 48 and cup register 42 so that the instrument operates at approximately mid-range when the helical spring is neither in tension nor compression. The deadband is thus determined. When the spring is compressed, i.e., in moving the pointer 120 to the lower ranges, it is found that the deadband remains substantially the same. Similarly, when the pointer is moved towards the higher pressure settings, i.e., the spring 20 is in tension, the deadband also remains the same. In one example, as for an instrument illustrated wherein it is used at pressure levels 300-psi apart, the deadband was 35-psi for the 750-psi setting of the disc spring loading and without tensioning or compressing the helical spring 20. The same deadband of 35-psi existed when the helical spring was placed in tension so as to operate at the 900-psi level. The deadband was slightly less than 35-psi, but more than 30-psi, upon further tensioning of the spring to effect instrument operation at the 1200-psi level, and similarly when the spring was compressed to effect operations at the 300-psi level.

Thus, not only is the deadband controlling mechanism of this invention unique for minimizing deadband fluctuations at significantly different pressure level operations of a pressure responsive device, but it permits one to manufacture or purchase such instruments with assurance that they can rely on a specific deadband characteristic, and accordingly to permit the same instrument to be used for widely different pressure situations by simplifying customer requirements to the mere adjustments of the helical spring condition of tension or compression. In this regard, this invention embraces helical spring configurations in which coil pitch varies along the spring length, e.g., wherein mid-turns are more closely spaced than turns nearer the ends, whereby to further tailor deadband control as desired.

Further, it is to be understood that this invention embraces the construction of a single helical spring on one side of a pressure actuatable member wherein such helical spring can be placed in tension or compression as desired to combine with the pressure actuatable member to establish a desired range within which, at a particular pressure level, the member is moved in one direction at a predetermined pressure and is permitted return movement at a second predetermined pressure. Thus, such construction is usable with any type of pressure responsive device incorporating a diaphragm or piston.

I claim:

1. In a pressure responsive device having a snap action disc spring which is actuated in response to fluid pressure, said actuation moving a movable element of an electrical switch, the improvement comprising:

a housing having an opening to which fluid under pressure may be applied, said disc spring being within said dressing;

a member covering said opening and adapted to prevent fluid from entering said housing, said member being coupled to said disc spring, said member being exposed to and being movable by fluid pressure to cause said disc spring to undergo snap action for operating said movable element, a helical spring in said housing;

means selectively positioning one end of said helical spring relative to the other end thereof so as to selectively place said helical spring in tension or in compression, and means coupling said one end of said helical spring to said disc spring, with the helical spring being in tension at fluid pressures above a predetermined pressure and in compression at fluid pressures below said predetermined pressure.

2. The combination of claim 1, including a yoke member mechanically coupled to said disc spring and to said other end of said helical spring.

3. The combination of claim 2, including a threaded rod extending from the exterior of said housing and through said helical spring;

a shoe element threaded onto said rod, said shoe element being shaped to matingly threadedly engage the end turn of said helical spring at said one end thereof, said rod at the exterior of said housing being adapted for rotation to effect movement of said shoe and said one end of said helical spring for tensioning or compressing said helical spring.

4. The combination of claim 3, wherein said yoke member has notches receiving portions of one or more turns of said helical spring at said other end thereof.

5. The combination of claim 4, wherein said member covering said opening includes a diaphragm spanning said opening;

and a pressure plate on the side of said diaphragm opposite the source of fluid pressure for transmitting movements of said diaphragm to said disc spring.

6. The combination of claim 2, including a fulcrum member, said yoke member having an opening, said fulcrum member extending through such opening and having spaced legs astride the position of said yoke member between said opening and said disc spring, said legs being in engagement with the inner peripheral edge of said disc spring;

a lever having an elongated leg and relatively short legs extending therefrom, one relatively short leg of said lever being in engagement with said fulcrum member, said one relatively short leg of said lever being supported for angular movement on an axis offset with respect to the spaced legs of said fulcrum member, whereby motion of said disc spring effects pivotal movement of said lever, the remaining relatively short leg of said lever being adapted to physically move a device to be controlled in response to fluid pressure.

* * * * *